United States Patent [19]

Karas

[11] Patent Number: 4,571,578

[45] Date of Patent: Feb. 18, 1986

[54] INTRUSION BARRIER AND DETECTION APPARATUS

[75] Inventor: Nicholas V. Karas, Lowell, Mass.

[73] Assignee: The United States of America as represented by the Secretary of the Air Force, Washington, D.C.

[21] Appl. No.: 486,478

[22] Filed: Apr. 19, 1983

[51] Int. Cl.[4] ..... G08B 13/00

[52] U.S. Cl. ..... 340/541; 256/12; 340/552; 340/564; 343/5 PD

[58] Field of Search ..... 340/564, 552, 541; 343/5 PD; 256/8, 10-12, 32; 200/61.93

[56] References Cited

U.S. PATENT DOCUMENTS

| | | | |
|---|---|---|---|
| 3,463,455 | 8/1969 | Meckel | 256/8 |
| 3,560,970 | 2/1971 | Kamimura et al. | 343/5 |
| 3,707,709 | 12/1972 | Wolf et al. | 340/552 |
| 3,778,805 | 12/1973 | Gould | 340/541 |
| 4,053,877 | 10/1977 | Torlesse et al. | 340/552 |
| 4,091,367 | 5/1978 | Harman | 340/258 A |
| 4,318,102 | 3/1982 | Poirier | 343/5 PD X |
| 4,327,358 | 4/1982 | Karas | 340/564 X |
| 4,382,291 | 5/1983 | Nakauchi | 343/5 PD X |
| 4,415,885 | 11/1983 | Mongeon | 340/552 |
| 4,419,659 | 12/1983 | Harman et al. | 343/5 PD X |
| 4,458,240 | 7/1984 | Rittenbach et al. | 340/552 |
| 4,503,423 | 3/1985 | Mainiero et al. | 340/552 |
| 4,525,701 | 6/1985 | Leih | 200/61.93 X |

FOREIGN PATENT DOCUMENTS

| | | | |
|---|---|---|---|
| 731916 | 4/1966 | Canada | 256/32 |
| 1233063 | 5/1971 | United Kingdom | 340/552 |
| 1289513 | 9/1972 | United Kingdom | 340/564 |
| 938853 | 7/1982 | U.S.S.R. | 256/32 |

OTHER PUBLICATIONS

Woode et al., "Perimeter Protection with Microwaves", *Microwave Systems News*, vol. 6, No. 4, pp. 113-114, 117-118, Sep. 1976.

*Primary Examiner*—James L. Rowland
*Assistant Examiner*—Thomas J. Mullen, Jr.
*Attorney, Agent, or Firm*—Donald J. Singer; Richard J. Donahue

[57] ABSTRACT

A ported coaxial cable is positioned within a coil of barbed wire and is coextensive therewith. Radio frequency energy applied to the cable is confined within the tubular volume of the coil. Variations in the reflected energy caused by physical disturbances of the coil are processed by detection system signal processing equipment to determine the incidence and location of intrusion events.

8 Claims, 4 Drawing Figures

FIG. 1
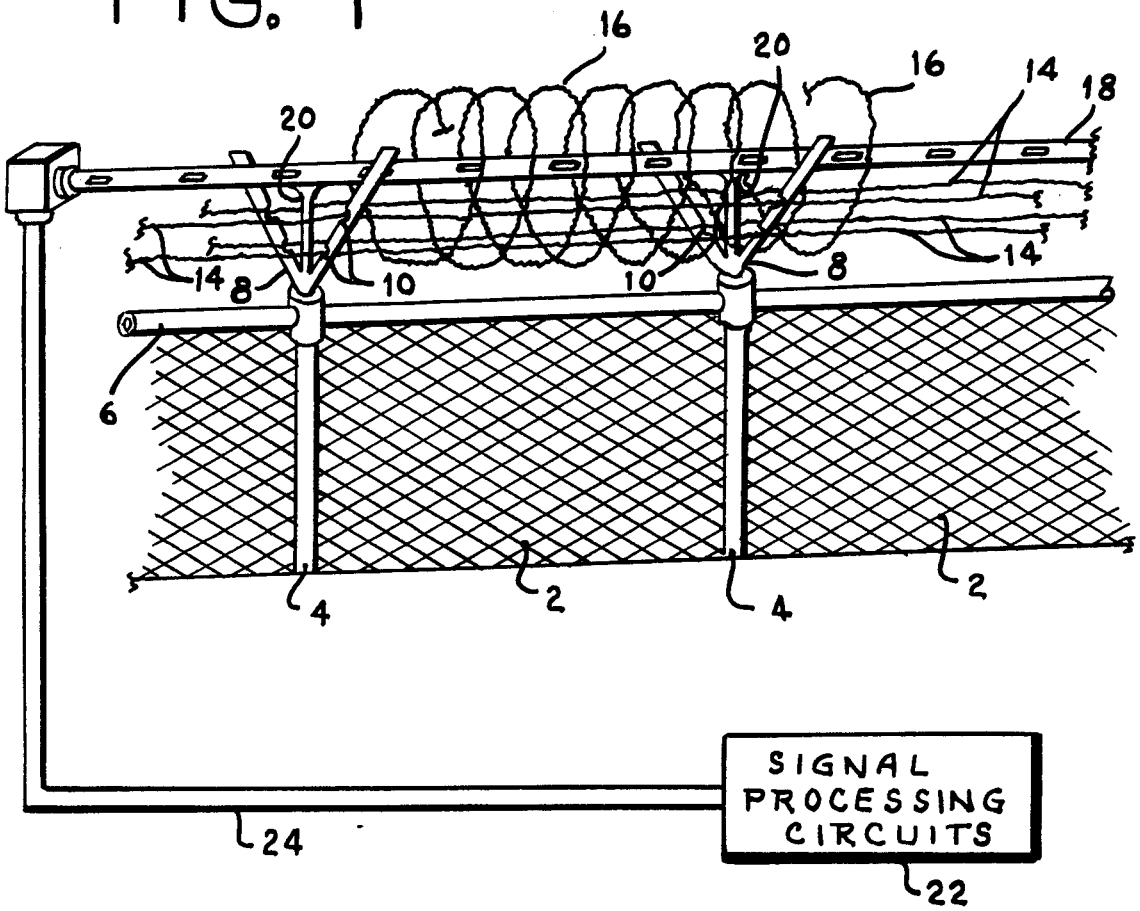
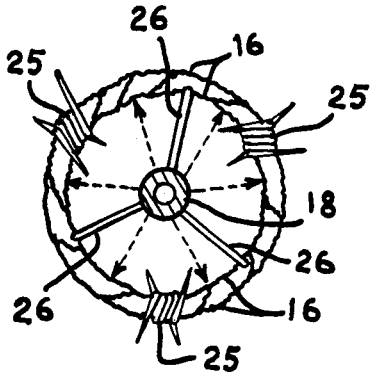
FIG. 2 a
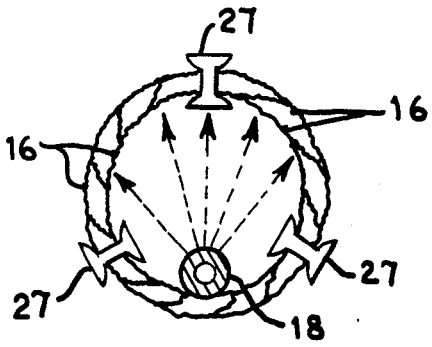
FIG. 2 b

INTRUSION BARRIER AND DETECTION APPARATUS

STATEMENT OF GOVERNMENT INTEREST

The invention described herein may be manufactured and used by or for the Government for governmental purposes without the payment of any royalty thereon.

BACKGROUND OF THE INVENTION

This invention relates to systems for the protection of secure areas, and to intruder detection systems. Specifically, it relates to an intruder detection system that can be integrated into a physical barrier and that is adapted to detect any physical deformation of the barrier.

It is often necessary to protect equipment and secure areas from unauthorized, unwanted and sometimes hostile personnel and vehicles. Such protection conventionally includes fencing that encompasses the area or equipment to be protected. Intruder detection systems are also used in conjunction with fences or other physical deterrent barriers to enable responsible personnel to monitor the premises and to take appropriate action in response to detected intrusions.

In U.S. Pat. No. 4,327,358, issued Apr. 27, 1982 to the present inventor, there is disclosed an integrated physical deterrent barrier and intruder detection sensor that provides surveillance of intrusions in the airspace over the barrier. The sensor is coextensive with and mounted on the top of the barrier and is integrated into a barbed wire topped chain link fence by arranging appropriately spaced parallel strands of barbed wire into a V configuration so as to form a corner reflector antenna at the system operating frequency. The active element of the corner reflecter is a leaky transmission line that extends the length of the corner reflector antenna, radiates RF energy and carries reflections from intrusion events back to a receiver and processing circuits.

While the aforementioned device has proven to be effective, it has been found to be susceptible to false alarms caused by birds and other non-target intrusions far above the physical barrier. Since it is a radiating device, it is also affected by the placement of objects in the vicinity of the device and furthermore it requires considerable power for its operation.

SUMMARY OF THE INVENTION

The present invention concerns a secure area protection system in which a physical deterrent barrier, such as a coil of barbed wire, has a ported coaxial cable coextensive with and mounted within the barbed wire coil. The ported coaxial cable illuminates the tubular volume within the barbed wire coil with RF energy from the intrusion detection system transmitter. Variations in radio frequency reflections caused by physical deformations of the barbed wire coil are processed by detection system signal processing equipment to determine the incidence and location of intrusion events.

In a preferred embodiment, the sensor is integrated into a barbed wire coil positioned atop a chain link fence and supported by parallel strands of barbed wire inserted into notches formed in V-shaped supports atop the fence.

It is a principle object of the invention to provide a new and improved secure area protection system.

It is another object of the invention to provide a physical deterrent barrier having a ported coaxial cable therein.

It is another object of the invention to provide a sensor for a ported or leaky transmission line type intruder detection system that is integrated within a physical deterrent barrier and that monitors the internal volume of the deterrent barrier.

It is another object of the invention to provide an integrated deterrent barrier-intruder detecting sensor that utilizes a barbed wire coil topped chain link fence and has no appearance of electronic surveillance capability.

These together with other objects, features and advantages of the invention will become more readily apparent from the following detailed description when taken in conjunction with the illustrative embodiments in the accompanying drawings wherein like elements are given like reference numerals throughout.

DESCRIPTION OF THE DRAWINGS

FIG. 1 is an isometric illustration of a physical deterrent barrier having a ported coaxial cable positioned within a helical barbed wire coil as comprehended by a preferred embodiment of the invention;

FIGS. 2A and 2B illustrate, in cross section, the positioning of the ported coaxial cable within the barbed wire coil.

DETAILED DESCRIPTION OF THE PREFERRED EMBODIMENT

Figure 3:
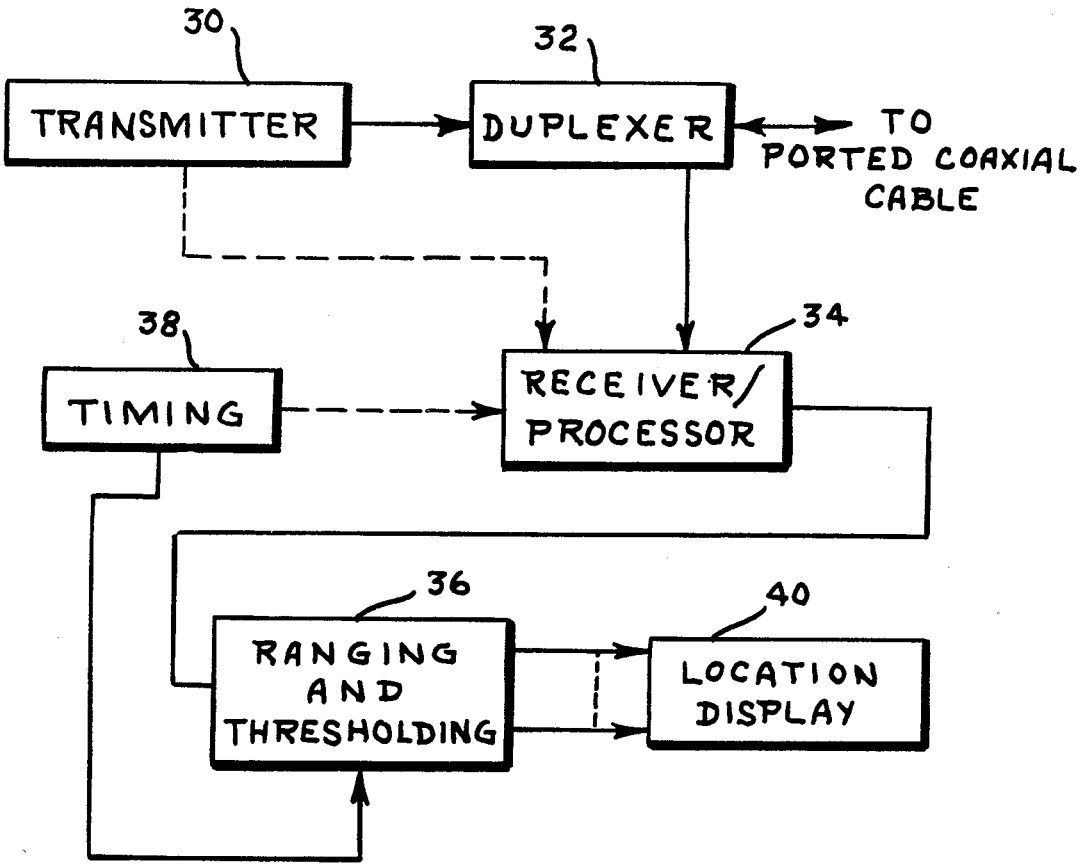
FIG. 3 is a block diagram of the signal transmitting, receiving and processing circuits for the type of intrusion and detection system to which the invention pertains.

Referring now to FIG. 1 of the drawings, there is shown a section of chain link fence 2 having vertical support posts 4 and a top rail 6. Positioned atop the posts 4 are V-shaped support arms 8 having notches therein which accept horizontal strands of barbed wire 14.

Positioned atop the horizontal strands of barbed wire 14, and supported thereby is a coil of barbed wire 16. The term "barbed wire" is intended herein to include wire having any form of sharp projections thereon which act as a physical deterrent. It would, for example, encompass a barbed tape projection as depicted in FIG. 2B. A ported coaxial cable 18 is disposed within a barbed wire coil 16 and extends throughout the length thereof. Cable 18 is supported at the longitudinal axis of coil 16 by a vertical support member 20 located at the junction of the V-arms 8. Signal processing circuits 22, are coupled to the ported coaxial cable 18 by way of a conventional coaxial cable 24.

FIGS. 2A and 2B illustrate two alternate ways of disposing the ported cable 18 within the coil 16. These Figures are purposely not drawn to scale for the sake of clarity of the individual elements. In FIG. 2A, the ported coaxial cable is held at the longitudinal axis of coil 16 by several support rods 26 which are attached to coil 16, while in FIG. 2B the ported cable 18 rests at the bottom inner surface of coil 16. FIG. 2A depicts several conventional barbs 25 while FIG. 2B depicts a form of barbed projection 27 known as barbed tape.

Electromagnetic theory states and practice shows that if the spacing between the individual turns of coil 16 is about a tenth of a wavelength or less, they will reflect any RF energy that strikes them and contain this energy within the interior volume of coil 16. In effect, the coil acts like a solid metal tube to RF energy. In a practical embodiment of the present invention the coil 16 may have a turn spacing of 4 inches and RF frequencies as high as 300 megaHertz will not leak out of the barbed wire coil. Many times, in practice, the interturn spacing is a fraction of an inch which, of course, allows higher RF frequencies to be used.

An alternate configuration of the present invention utilizes two wire coils, one assembled within the other and having opposite winding directions. The two coil loops are tied together with metal ropes to maintain a predetermined spacing. With this configuration the coil turn spacing is not as critical because energy leaking through the inner coil will reflect from the metal ropes and outer coil strands randomly and be cancelled. Little, if any, radiation will escape outside the outer coil. Therefore, much higher frequencies can be used.

Either one or two ported coaxial cables could be used within the barbed wire coil 16. If one cable is used, that cable transmits the RF energy and also receives reflection purturbations caused by an intruder. When two ported coaxial cables are used, one cable transmits the energy throughout the interior of the coil 16 while the other receives reflections produced by disturbances of the electromagnetic field resulting from a physical deformation of the barbed wire coil by an intruder.

FIG. 3 is a block diagram of the electronic hardware and signal processing circuitry associated with the invention. This comprises a transmitter 30, a duplexer 32, receiver/processor 34, ranging and thresholding circuits 36, timing circuit 38 and location display 40, all of which are conventional in design and commonly used in conjunction with leaky transmission line radar ranging type intruder detection systems.

While the invention has been described in terms of its preferred embodiments it is understood that the words which have been used are words of description rather than words of limitation and the changes within the purview of the appended claims may be made without departing from the scope and spirit of the invention in its broader aspects.

What is claimed is:

1. An intrusion barrier and detector comprising:

a coil of wire, a ported coaxial cable positioned within said coil of wire and extending along the length thereof, and a radio frequency signal transceiver system coupled to said ported coaxial cable, said radio frequency transceiver system being adapted to transmit radio frequency energy to said ported coaxial cable and to receive radio frequency signals from said ported coaxial cable indicative of physical disturbances of said coil of wire, said coil of wire having an interturn spacing not exceeding $0.1\lambda$, where $\lambda$ is the wavelength of said radio frequency energy.

2. Apparatus as defined in claim 1 wherein said coil of wire has a plurality of sharp projections thereon.

3. Apparatus as defined in claim 2 and further including means for supporting said coil of wire atop a fence.

4. Apparatus as defined in claim 3 wherein said means for supporting said coil of wire atop a fence comprises:

a plurality of V-arm supports connected to the top of the support posts of said fence, and a plurality of parallel strands of wire positioned in said V-arm supports.

5. Apparatus as defined in claim 4 wherein said ported coaxial cable is positioned at the longitudinal axis of said coil of wire.

6. Apparatus as defined in claim 4 wherein said ported coaxial cable rests against the bottom interior surface of said coil of wire.

7. Apparatus as defined in claim 5 wherein the mean diameter of said coil of wire is within the range of thirty to forty inches.

8. Apparatus as defined in claim 7 wherein the spacing between turns of said coil of wire does not exceed four inches and the frequency of said radio frequency tranceiver system does not exceed 295 megaHertz.

* * * * *